US006029748A

United States Patent [19]

Forsyth et al.

[11] Patent Number: 6,029,748

[45] Date of Patent: Feb. 29, 2000

[54] METHOD AND APPARATUS FOR TOP TO BOTTOM EXPANSION OF TUBULARS

[75] Inventors: David G. Forsyth, Oldemldrum Inverurie; Robert C. Ross, Larishill Newmacher, both of United Kingdom

[73] Assignee: Baker Hughes Incorporated, Houston, Tex.

[21] Appl. No.: 08/943,954

[22] Filed: Oct. 3, 1997

[51] Int. Cl.[7] ..... E21B 29/00

[52] U.S. Cl. ..... 166/380; 166/277

[58] Field of Search ..... 166/277, 382, 166/212, 313, 341, 380

[56] References Cited

U.S. PATENT DOCUMENTS

| | | |
|---|---|---|
| 1,634,891 | 7/1927 | Trout . |
| 2,017,451 | 10/1935 | Wickersham . |
| 2,583,316 | 1/1952 | Bannister . |
| 2,593,725 | 4/1952 | Brown . |
| 3,163,217 | 12/1964 | Haeber . |
| 3,179,168 | 4/1965 | Vincent . |
| 3,191,677 | 6/1965 | Kinley . |
| 3,191,680 | 6/1965 | Vincent . |
| 3,203,451 | 8/1965 | Vincent . |
| 3,203,483 | 8/1965 | Vincent . |

(List continued on next page.)

FOREIGN PATENT DOCUMENTS

| | | |
|---|---|---|
| 93/25799 | 12/1993 | WIPO . |
| 97/20130 | 6/1997 | WIPO . |
| 98/00626 | 1/1998 | WIPO . |

OTHER PUBLICATIONS

"A System: Reeled Completions, Casings and Flowlines," *Reeled Systems Technology*, date unknown, 16–21.

Petroline EST Well Systems brochure, date unknown, 8 pages.

Abdrakhmanov, et al., "Isolation Profile Liner Helps Stabilize Problem Well Bores," *Oil & Gas Journal*, Sep. 1995, 50–52.

Gill, et al., "Expandable Tube is Novel Tool for Difficult Completions, Drilling," *Oil & Gas Journal*, Jun. 1996, 37–40.

Vincent, et al., "Stressed Steel Liner Yields Stronger Casing Repairs," *Journal of Petroleum Technology*, Dec. 1962, 1337–1341.

(List continued on next page.)

*Primary Examiner*—Frank Tsay

*Attorney, Agent, or Firm*—Duane, Morris & Heckscher, LLP

[57] ABSTRACT

An apparatus and method are disclosed that allow for downhole expansion of long strings of rounded tubulars, using a technique that expands the tubular from the top to the bottom. The apparatus supports the tubular to be expanded by a set of protruding dogs which can be retracted if an emergency release is required. A conically shaped wedge is driven into the top of the tubing to be expanded. After some initial expansion, a seal behind the wedge contacts the expanded portion of the tube. Further driving of the wedge into the tube ultimately brings in a series of back-up seals which enter the expanded tube and are disengaged from the driving mandrel at that point. Further applied pressure now makes use of a piston of enlarged cross-sectional area to continue the further expansion of the tubular. When the wedge has fully stroked through the tubular, it has by then expanded the tubular to an inside diameter larger than the protruding dogs which formerly supported it. At that point, the assembly can be removed from the wellbore. An emergency release, involving dropping a ball and shifting a sleeve, allows, through the use of applied pressure, the shifting of a sleeve which supports the dog which in turn supports the tubing to be expanded. Once the support sleeve for the dog has shifted, the dog can retract to allow removal of the tool, even if the tube to be expanded has not been fully expanded.

22 Claims, 5 Drawing Sheets

U.S. PATENT DOCUMENTS

| | | | |
|---|---|---|---|
| 3,245,471 | 4/1966 | Howard . | |
| 3,326,293 | 6/1967 | Skipper | 166/277 |
| 3,353,599 | 11/1967 | Swift . | |
| 3,358,760 | 12/1967 | Blagg . | |
| 3,477,506 | 11/1969 | Malone | 166/277 |
| 3,489,220 | 1/1970 | Kinley . | |
| 3,710,864 | 1/1973 | Mitchell . | |
| 3,712,376 | 1/1973 | Owen et al. . | |
| 3,746,091 | 7/1973 | Owen et al. . | |
| 3,785,193 | 1/1974 | Kinley et al. . | |
| 3,865,408 | 2/1975 | Young . | |
| 3,948,321 | 4/1976 | Owen et al. | 166/277 |
| 4,483,399 | 11/1984 | Colgate . | |
| 4,501,327 | 2/1985 | Retz . | |
| 4,660,863 | 4/1987 | Bailey et al. . | |
| 4,781,249 | 11/1988 | Wood . | |
| 4,796,709 | 1/1989 | Lynde et al. . | |
| 4,830,109 | 5/1989 | Wedel . | |
| 4,897,139 | 1/1990 | Wood . | |
| 4,907,651 | 3/1990 | Bou-Mikael . | |
| 4,967,846 | 11/1990 | Wood . | |
| 4,976,322 | 12/1990 | Abdrakhmanov et al. | 175/57 |
| 5,031,699 | 7/1991 | Artynov et al. . | |
| 5,037,879 | 8/1991 | Roberts . | |
| 5,040,283 | 8/1991 | Pelgrom . | |
| 5,083,608 | 1/1992 | Abdrakhmanov et al. . | |
| 5,119,661 | 6/1992 | Abdrakhmanov et al. . | |
| 5,327,962 | 7/1994 | Head . | |
| 5,333,692 | 8/1994 | Baugh et al. . | |
| 5,337,823 | 8/1994 | Nobileau . | |
| 5,348,095 | 9/1994 | Worrall et al. . | |
| 5,366,012 | 11/1994 | Lohbeck | 166/277 |
| 5,390,742 | 2/1995 | Dines et al. . | |
| 5,456,312 | 10/1995 | Lynde et al. . | |
| 5,494,106 | 2/1996 | Gueguen et al. . | |
| 5,667,011 | 9/1997 | Gill et al. . | |
| 5,787,984 | 8/1998 | Mabile | 166/277 |

OTHER PUBLICATIONS

Kemp, "Field Results of the Stressed Steel Liner Casing Patch," *Journal of Petroleum Technology*, Feb. 1964, 147–149.

Weatherford Enterra advertisement and information regarding Homoco Casing Patches.

Bowen Packer Type Tubing and Casing Patches; p. 930.

2314 Gotco International, Inc. "Casing Patch," p. 12.

"Rubber Seal Casing Patch and Rubber Seal Underwater Casing Patch"; Prod. Nos. 161–20 and 160–78; Baker Oil Tools' Fishing Services, p. 13–16.

"High Pressure Pack–off"; Prod. No. 110–59, Baker Oil Tools' Fishing Services, p. 54.

METHOD AND APPARATUS FOR TOP TO BOTTOM EXPANSION OF TUBULARS

FIELD OF THE INVENTION

The field of this invention relates to a method and apparatus of running downhole tubing or casing of a size smaller than tubing or casing already set in the hole and expanding the smaller tubing to a larger size downhole.

BACKGROUND OF THE INVENTION

Typically, as a well is drilled, the casing becomes smaller as the well is drilled deeper. The reduction in size of the casing restrains the size of tubing that can be run into the well for ultimate production. Additionally, if existing casing becomes damaged or needs repair, it is desirable to insert a patch through that casing and be able to expand it downhole to make a casing repair, or in other applications to isolate an unconsolidated portion of a formation that is being drilled through by running a piece of casing in the drilled wellbore and expanding it against a soft formation, such as shale.

Various techniques of accomplishing these objectives have been attempted in the past. In one technique developed by Shell Oil Company and described in U.S. Pat. No. 5,348,095, a hydraulically actuated expanding tool is inserted in the retracted position through the tubular casing to be expanded. Hydraulic pressure is applied to initially expand the tubular member at its lower end against a surrounding wellbore. Subsequently, the hydraulic pressure is removed, the expanding tool is lifted, and the process is repeated until the entire length of the casing segment to be expanded has been fully expanded from bottom to top. One of the problems with this technique is that it is uncertain as to the exact position of the expanding tool every time it is moved from the surface, which is thousands of feet above where it is deployed. As a result, there's no assurance of uniform expansion throughout the length of the casing to be expanded using this technique. Plus, the repeated steps of application and withdrawal of hydraulic pressure, coupled with movements in the interim, are time-consuming and do not yield with any certainty a casing segment expanded along its entire length to a predetermined minimum inside diameter. U.S. Pat. No. 5,366,012 shows a perforated or slotted liner segment that is initially rigidly attached to the well casing and expanded by a tapered expansion mandrel. This system is awkward in that the slotted liner with the mandrel is installed with the original casing, which requires the casing to be assembled over the mandrel.

Other techniques developed in Russia and described in U.S. Pat. Nos. 4,976,322; 5,083,608; and 5,119,661 use a casing segment which is specially formed, generally having some sort of fluted cross-section. The casing segment to be expanded which has the fluted shape is subjected to hydraulic pressure such that the flutes flex and the cross-sectional shape changes into a circular cross-section at the desired expanded radius. To finish the process, a mechanical roller assembly is inserted into the hydraulically expanded fluted section. This mechanical tool is run from top to bottom or bottom to top in the just recently expanded casing segment to ensure that the inside dimension is consistent throughout the length. This process, however, has various limitations. First, it requires the use of a pre-shaped segment which has flutes. The construction of such a tubular shape necessarily implies thin walls and low collapse resistance. Additionally, it is difficult to create such shapes in a unitary structure of any significant length. Thus, if the casing segment to be expanded is to be in the order of hundreds or even thousands of feet long, numerous butt joints must be made in the fluted tubing to produce the significant lengths required. Accordingly, techniques that have used fluted tubing, such as that used by Homco, now owned by Weatherford Enterra Inc., have generally been short segments of around the length of a joint to be patched plus 12–16 ft. The technique used by Hornco is to use tubing that is fluted. A hydraulic piston with a rod extends through the entire segment to be expanded and provides an upper travel stop for the segment. Actuation of the piston drives an expander into the lower end of the specially shaped fluted segment. The expander may be driven through the segment or mechanically yanked up thereafter. The shortcoming of this technique is the limited lengths of the casing to be expanded. By use of the specially made fluted cross-section, long segments must be created with butt joints. These butt joints are hard to produce when using such special shapes and are very labor-intensive. Additionally, the self-contained Homco running tool, which presents an upper travel stop as an integral part of the running tool at the end of a long piston rod, additionally limits the practical length of the casing segment to be expanded.

What is needed is an apparatus and method which will allow use of standard pipe which can be run in the wellbore through larger casing or tubing and simply expanded in any needed increment of length. It is thus the objective of the present invention to provide an apparatus and technique for reliably inserting the casing segment to be expanded and expanding it to a given inside dimension, while at the same time accounting for the tendency of its overall length to shrink upon expansion. Those and other objectives will become apparent to those of skill in the art from a review of the specification below.

SUMMARY OF THE INVENTION

An apparatus and method are disclosed that allow for downhole expansion of long strings of rounded tubulars, using a technique that preferably expands the tubular from the top to the bottom. The apparatus supports the tubular to be expanded by a set of protruding dogs which can be retracted if an emergency release is required. A conically shaped wedge is driven into the top of the tubing to be expanded. After some initial expansion, a seal behind the wedge contacts the expanded portion of the tube. Further driving of the wedge into the tube ultimately brings in a series of back-up seats which enter the expanded tube and are disengaged from the driving mandrel at that point. Further applied pressure now makes use of a piston of enlarged cross-sectional area to continue the further expansion of the tubular. When the wedge has fully stroked through the tubular, it has by then expanded the tubular to an inside diameter larger than the protruding dogs which formerly supported it. At that point, the assembly can be removed from the wellbore. An emergency release, involving dropping a ball and shifting a sleeve, allows, through the use of applied pressure, the shifting of a sleeve which supports the dog which in turn supports the tubing to be expanded. Once the support sleeve for the dog has shifted, the dog can retract to allow removal of the tool, even if the tube to be expanded has not been fully expanded.

DETAILED DESCRIPTION OF THE PREFERRED EMBODIMENT

Figure 1A:
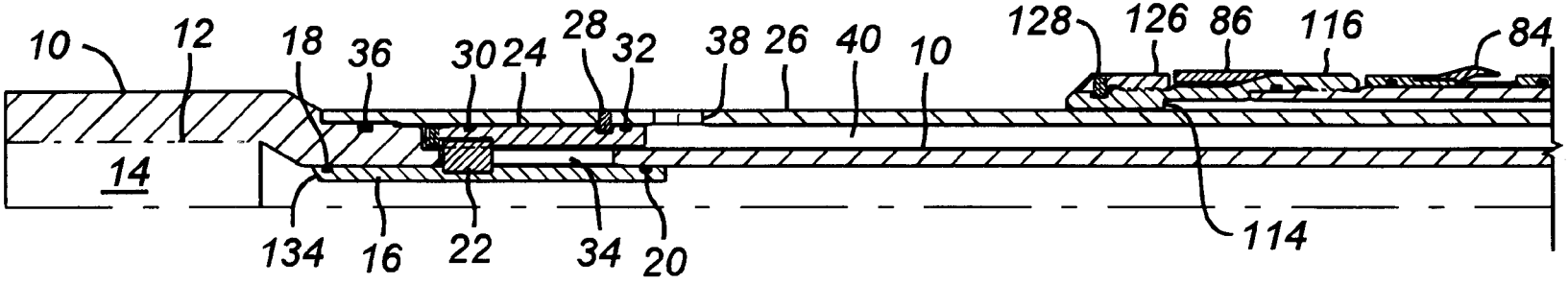
FIGS. 1*a*–1*d* are a sectional view of the tool supporting a piece of tubing to be expanded just prior to any actual expansion.

The apparatus A has a top sub 10 which is connected to a tubing string to the surface (not shown) at thread 12. As shown in FIG. 1*a,* the top sub 10 has a central passage 14. Located within passage 14 is seat sleeve 16. Sleeve 16 has seals 18 and 20 at its upper and lower ends, respectively. In the run-in position as shown in FIG. 1*a,* sleeve 16 supports key 22 on one side. Key 22 also extends into sleeve 24. Sleeve 24 is, in turn, connected to outer sleeve 26 via shear pin 28. Key 22 engages sleeve 24. Seals 30 and 32 straddle the opening in the outer sleeve 26 through which the shear pin 28 extends. Key 22 extends through a window 34 in top sub 10. Seal 36 seals between top sub 10 and outer sleeve 26. Outer sleeve 26 has a port 38 which communicates with cavity 40. Cavity 40 has an outlet 42 which extends into passage 44 in plug 46. Plug 46 has a longitudinal passage 48 which is in fluid communication with passage 14 at its upper end and annular cavity 50 at its opposite end. Cavity 50 communicates with cavity 52 through port 54. At its outer upper end, the cavity 52 is sealed by seal 56. At its lower inside end, cavity 52 is sealed by seal 58.

Figure 1B:
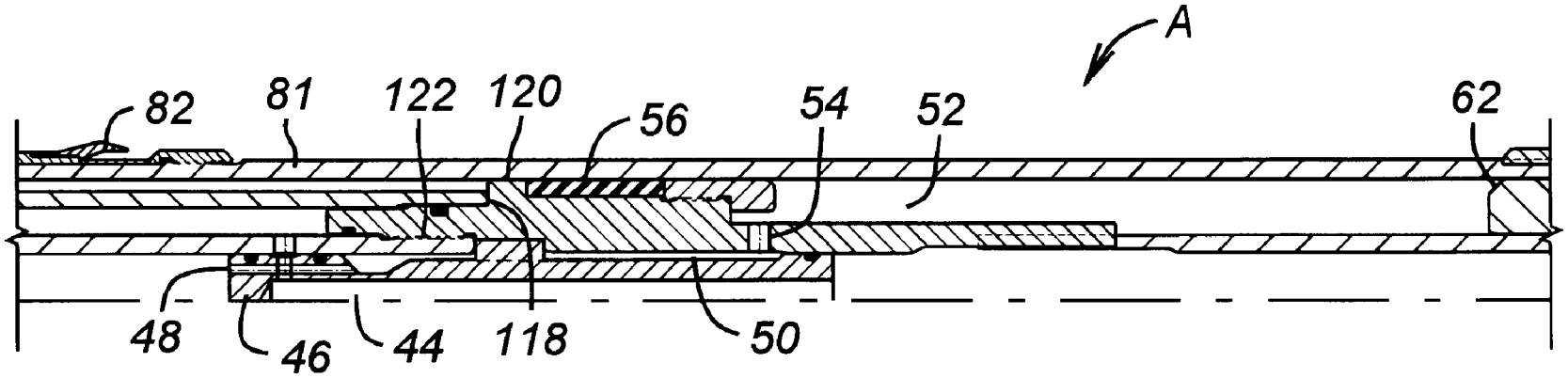
Figure 1C:
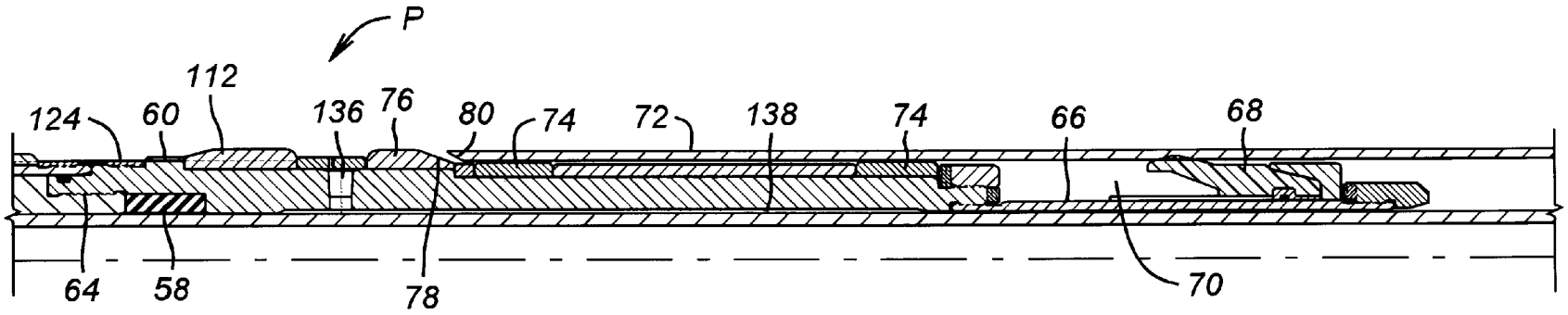

The piston P comprises a body 60, connected to a top sub 62 at thread 64. At the lower end of body 60 is bottom sub 66 which supports a cup seal 68. Cup seal 68 isolates a cavity 70 which is preferably grease-filled. In the run-in position shown in FIGS. 1*a*–1*d,* the cup seal 68 is located within the tubing 72, which is to be expanded. Body 60 also has a wear ring(s) 74, which are initially within the tubing 72 to be expanded during run-in, as shown in FIG. 1*c*.

The expansion of the tubing 27 is accomplished by wedge 76, which is preferably made of a ceramic material and has a conical leading end 78. The taper of the conical leading end 78 preferably matches the taper 80 of the tubing 72 to be expanded in the preferred embodiment. The body 60 also has an outer sleeve component 81 which supports cup seals 82 and 84, as well as slips 86.

Figure 1D:
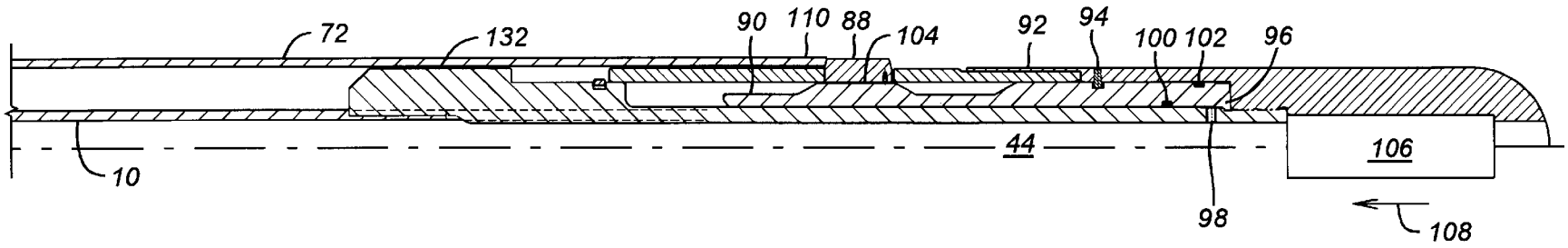
Figure 2:
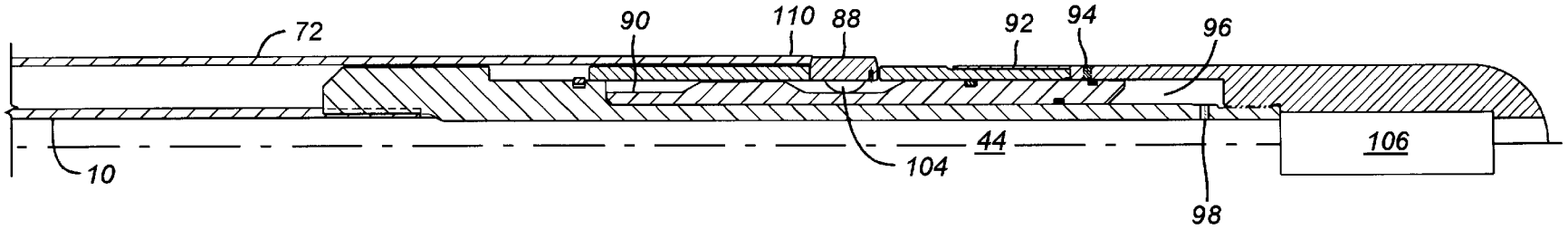
FIG. 2 indicates the emergency release position where the locking dogs that support the tubing to be expanded can now retract to allow removal of the tool from the wellbore.

Referring now to the lower end shown in FIG. 1*d,* dogs 88 are supported in the position shown in FIG. 1*d* by sleeve 90. Sleeve 90 is secured to bottom sub 92 at shear pin 94. A cavity 96 is in fluid communication with passage 44 through port 98. Seals 100 and 102 seal cavity 96 around sleeve 90. The dogs 88 are radially biased outwardly by springs 104, which are best seen in FIG. 2. At the bottom sub 92, there is a check valve 106 which permits flow only in the direction of arrow 108 into passage 44 from the outer annulus around the tool. As shown in FIG. 1*d,* the dogs 88 support the lower end 110 of the tubing 72. The tubing 72 is preferably rounded, commonly used oilfield tubulars that are connected by known means, preferably threaded connections. As such they can be assembled into a significantly long stretch, well in excess of the fluted tubulars of the prior art, which were limited to the length of a joint (about 40 ft.) plus 6–8 ft. at each end, for a total of about 60 ft., with one of the limitations on the overall length being the stress on the components, starting at dogs 88, which support the weight of the entire run of the tubing 72.

The principal components now having been described, the operation of the tool will be described in more detail. As previously stated, FIGS. 1*a*–1*d* represent the run-in position. As can be seen in FIG. 1*d,* the dogs 88 support the string of tubing 72 to be expanded. Pressure is initially applied from the surface into passage 14. Sleeve 16 with seals 18 and 20 ensure that pressure is communicated through passage 14 into passage 48 through cavity 50 and port 54, and into cavity 52. An increase in pressure in cavity 52 acts on a piston area of top sub 62 as measured by the limiting seals 56 and 58 at the top and bottom of cavity 52, respectively. Thus, the application of pressure in cavity 52 begins to move the wedge 76 and its leading conical end 78 into the tubing 72 to start the expansion. At this time, the tubing 72 is supported off dogs 88. Further pressurization continues the stroking of body 60 of piston P until a seal 112, also preferably made of ceramic material, enters the tubing 72 in a portion that has previously been expanded by wedge 76. The objective is to obtain a seal between the tubing 72, that has already been flared out by wedge 76, and seal 112. Continuation of application of pressure to cavity 52 moves the body 60 of piston P further until the cup seals 82 and 84 and the slips 86 enter the top end of the tubing 72 which has already been flared. At this point, an inside shoulder 114 (see FIG. 1*a*) on a cap 116, which is a part of outer sleeve 81 of piston P, bottoms on radial surface 118. Radial surface 118 is located on sleeve 120, which is in turn connected to top sub 10 at thread 122. Sleeve 120 supports seal 56, as shown in FIG. 1*b*. As shown in FIGS. 1*b* and 1*c,* outer sleeve 81 is secured to body 60 by ring 124. As further pressure is applied in cavity 52, with outer sleeve 81 retained due to the engagement of shoulder 114 with radial surface 118, ring 124 shears in two, terminating the connection between the body 60 and the outer sleeve 81. By this time, as previously stated, the cup seals 82 and 84 and slips 86 have entered the expanded tubular 72. Due to the break of ring 124, the driving piston area increases. On the outside, seal 112 now defines the piston area instead of seal 56. In essence, cavity 52 is redefined and is now expanded to the tubing inside diameter sealed off by cup seals 82 and 84 which are backed up by slips 86. Applied pressure now acts on seal 112 at the outside and seal 56 on the inside as the balance of tube 72 is expanded. The pressure acting to push the outer sleeve 81 out of the expanded tubular 72 is resisted by slips 86, which provide the back-up resistance required as a taper on cap 116 cams the slips 86 outwardly in response to uphole pressures within the tubular 72 applied to the cup seals 82 and 84. The slips 86 are retained by ring 126, which is threaded to cap 116 and its position is secured by pin 128. Those skilled in the art will appreciate that for retrieval, radial surface 118 will reengage shoulder 114 and bring out the outer sleeve 81 and all the components connected to it. At this time, the external toothed profile on the slip 86 will have overstressed and failed in shear.

Once the ring 124 has been parted and body 60 continues to move downwardly, the wedge 76 continues its movement through the tubing 72 to be expanded. As this movement is going on, grease is being distributed on the inside diameter of the tubing 72 from cavity 70. The process of expansion of the tubing 72 can result in longitudinal shrinkage. It can also work harden the tubing 72 being expanded. Since the upper end of the tubing 72 will have already been expanded by the wedge 76, shrinkage is most likely to be seen by the lower end 110 moving away from dogs 88. The shrinkage, which is estimated to be in the order of 3–5%, should facilitate complete movement of the wedge 76 through the tubing 72 before ring 130, which is at the lower end of bottom sub 66, as shown in FIG. 1*c,* contacts sleeve 132, which is secured to the body 10 (see FIG. 1*d*). If additional stroking of the wedge 76 is necessary to conclude the expansion of the tubular 72, setdown weight can be applied at the surface to lower sleeve 132 and then pressure can be reapplied from the surface internally to drive the wedge 76 further until it clears the bottom of the tubular 72.

In order to emergency release, a ball is dropped to land on seat 134, shown in FIG. 1*a* as a part of seat sleeve 16. With the application of pressure in passage 14, with a ball (not shown) seated on seat 134, the sleeve 16 shifts, moving with it sleeve 24 which breaks shear pin 28. Sleeve 24 moves into position where seals 32 and 36 straddle the port 38. Thereafter, applied pressure in passage 14 passes through cavity 40, through crossover port or outlet 42, then into passage 44. The check valve 106 prevents escape of such fluid passing through passage 44 so that pressure builds in port 98 and cavity 96. This build-up of pressure in cavity 96 forces the shear pin 94 to break, which allows the sleeve 90 to shift to the position shown in FIG. 2, undermining support for the dogs 88. An upward pull from the surface will force the dogs 88 against the spring force of springs 104 so that they retract to within the tubular 72, portions of which at this time have not yet been expanded. Thus, the entire assembly can be removed if for any reason an emergency release is required. The tool must then be brought to the surface and redressed.

Another feature of the tool should be noted. As the wedge 76 enters the tubing 72, a new seal is formed with seal 112. The piston area for the pressure in chamber 52 is thus increased. Whereas initially the driving piston area was the area between seals 56 and 58, upon entry of seal 112 the driving piston area now is the space between seals 58 and 112, which is greater. Since during the expansion operation there is contact between wedge 76 and the tubing 72 to be expanded, any leakage while a driving force is applied to the piston P around the seal 112 will go through a weep hole 136, where it will escape to the annulus through passage 138. As a result, all further driving of the piston P will cease if seal 112 begins to leak inside the tubing 72. The purpose of the weep hole 136 is to avoid overstressing the tubing 72 by continuing to drive the wedge 76, even if seal 112 is passing fluid. Driving wedge 76 with a greater piston area reduces the stress on tubing 72 as the required force to move piston P is also reduced.

Those skilled in the art can appreciate that the apparatus and method as described above can accommodate standard oilfield tubulars of extremely long lengths. The only limiting factors on the length of the tubing 72 to be expanded are issues of wear on the seals 112 and 58 as the piston P is driven, as well as the stresses applied to the body 10 from the weight of the string 72 to be expanded. It is also within the scope of the invention to use a wedge construction for wedge 76 that is not simply just fixed in shape. The degree of expansion of a given string of tubulars 72 can be adjusted if an adjustable wedge is used for wedge 76. Thus, for example, the wedge can be segmented with a camming sleeve behind it which can vary the outside diameter of the wedge as desired. The diameter can be increased or decreased as desired as the tubing is expanded. Additionally, if for any reason it is desired, the tubing 72 can be expanded along its length to different inside and outside diameters, as desired. An adjustable wedge can also facilitate removal of the apparatus A at any time during the process. The emergency release feature as described allows for ready removal of the assembly should it become necessary. The expansion of the tubing 72 is facilitated by the reservoir of grease in cavity 70 which is distributed along the internal wall of tubing 72 as the wedge 76 progresses. With the use of the cup seals 82 and 84, the piston area is enlarged once the ring 124 is broken. Thus, the upper end of the tubing 72 is closed off to allow the application of pressure across a piston area spanning from seal 58 to seal 112. Fluid displaced in front of the piston will not pressurize the formation but will be rerouted back up through the check valve 106 into passage 44, out through outlet 42 into passage 40, then out through outlet 38 into the upper annulus.

The foregoing disclosure and description of the invention are illustrative and explanatory thereof, and various changes in the size, shape and materials, as well as in the details of the illustrated construction, may be made without departing from the spirit of the invention.

I claim:

1. A method of expanding tubulars downhole, comprising:

supporting at least one rounded tubular on a tool;

positioning the rounded tubular in a well;

forcibly increasing the diameter of the rounded tubular downhole;

using a wedge to expand the tubular;

changing the area of a piston driving the wedge during the expansion.

2. The method of claim 1, further comprising:

distributing a lubricant within the tubular to be expanded in advance of movement of the wedge to expand that portion of the tubular.

3. The method of claim 2, further comprising:

providing a passage through the tool for fluids within the tubular to flow through as the tool advances to avoid pressurizing the formation below the tubular with such fluid.

4. The method of claim 3, further comprising:

providing an emergency release between the tubular and the tool.

5. The method of claim 4, further comprising:

supporting the tubular on a movable support on the tool;

selectively retracting the support from the tubular;

removing the tool through the tubular.

6. The method of claim 2, further comprising:

providing a reservoir of lubricant in the tool which advances into the tubing before the wedge;

distributing lubricant within the tubular in advance of movement of the wedge to expand it.

7. The method of claim 3, further comprising:

providing a breakable component in the piston;

breaking off the breakable component;

exposing a greater piston area to applied pressure after the breaking of the component.

8. The method of claim 7, further comprising:

mounting the wedge to the piston;

mounting an outermost seal adjacent the wedge to act as an outer piston seal only after the breaking of the component.

9. The method of claim 8, further comprising:

using a sleeve as the breakable component;

disposing the piston at least in part within the sleeve;

providing an outer seal on the piston in contact with the inside of the sleeve;

providing an inner seal on the piston which contacts the body of the tool;

using the initial piston area between the inner and outer seals to advance the wedge into the tubular.

10. The method of claim 9, further comprising:

moving the sleeve with the piston until it enters the tubular;

using a seal on the outside of the sleeve to engage the inside of the tubular;

breaking the sleeve from the piston with the seal on the outside of the sleeve engaged to the tubular;

building pressure on the enlarged piston area represented by the outermost seal adjacent the wedge and the outside of the inner seal;

using the seal on the sleeve, which is now in sealing contact against the tubular, to contain the applied pressure on the now-enlarged piston area.

11. The method of claim 10, further comprising:

providing a leakpath from between the wedge and the outermost seal to above the tool so that any leakage around the outermost seal will not result in pressure build-up directly on the wedge.

12. The method of claim 10, further comprising:

using cup seals on the sleeve to engage the inside of the tubular;

holding the sleeve and cup seals to the tubular with at least one slip.

13. A method of expanding tubulars downhole, comprising:

supporting at least one rounded tubular on a tool;

positioning the rounded tubular in a well;

forcibly increasing the diameter of the rounded tubular downhole;

using a plurality of rounded tubulars connected by at least one joint;

expanding the diameter of the tubulars and the joint downhole.

14. The method of claim 13, further comprising:

threading a plurality of rounded tubulars together to make a tubing string;

positioning the string in the wellbore;

forcibly increasing the diameter of the tubulars and the threads that connect them in the wellbore.

15. The method of claim 14, further comprising:

using a wedge to expand the tubulars;

changing the area of a piston driving the wedge during the expansion.

16. The method of claim 12, further comprising:

providing a breakable component in the piston;

breaking off the breakable component;

exposing a greater piston area to applied pressure after the breaking of the component.

17. The method of claim 14, further comprising:

distributing a lubricant within the tubulars to be expanded in advance of movement of the wedge to expand that portion of the tubulars.

18. The method of claim 14, further comprising:

providing a passage through the tool for fluids within the tubulars to flow through as the tool advances to avoid pressurizing the formation below the tubulars with such fluid.

19. The method of claim 14, further comprising:

providing an emergency release between the tubulars and the tool.

20. A method of expanding tubulars downhole, comprising:

supporting at least one rounded tubular on a tool;

positioning the rounded tubular in a well;

forcibly increasing the diameter of the rounded tubular downhole;

using a wedge to expand the tubular;

providing a wedge with a variable diameter.

21. The method of claim 20, further comprising:

expanding the tubular to more than one diameter along its length.

22. The method of claim 20, further comprising:

reducing the diameter of the wedge to facilitate extraction of the tool.

* * * * *